United States Patent [19]

Tsuji

[11] Patent Number: 5,058,711

[45] Date of Patent: Oct. 22, 1991

[54] GROUP-SUPERVISING AN ELEVATOR SYSTEM

[75] Inventor: Shintaro Tsuji, Inazawa, Japan

[73] Assignee: Mitsubishi Denki Kabushiki Kaisha, Japan

[21] Appl. No.: 497,909

[22] Filed: Mar. 23, 1990

[30] Foreign Application Priority Data

Apr. 6, 1989 [JP] Japan ..... 1-87547

[51] Int. Cl.[5] ..... B66B 1/18

[52] U.S. Cl. ..... 187/124; 187/128

[58] Field of Search ..... 187/124, 127, 128

[56] References Cited

U.S. PATENT DOCUMENTS

| | | | |
|---|---|---|---|
| 3,831,715 | 8/1974 | Matsuzawa et al. | 187/128 |
| 3,895,692 | 7/1975 | Yeasting | 187/128 |
| 4,503,941 | 3/1985 | Takabe | 187/128 |
| 4,669,579 | 6/1987 | Ookubo | 187/124 |
| 4,846,311 | 7/1989 | Thangavelu | 187/128 X |
| 4,875,554 | 10/1989 | MacDonald et al. | 187/124 |

FOREIGN PATENT DOCUMENTS

| | | |
|---|---|---|
| 59-48366 | 3/1984 | Japan . |
| 61-37187 | 8/1986 | Japan . |
| 62-56076 | 11/1987 | Japan . |
| 2222275 | 10/1989 | United Kingdom . |

*Primary Examiner*—A. D. Pellinen
*Assistant Examiner*—W. E. Duncanson, Jr.
*Attorney, Agent, or Firm*—Leydig, Voit & Mayer

[57] ABSTRACT

A method and apparatus for group-supervising an elevator system according to this invention consists in predicting the position of operating cages after the lapse of a predetermined time, detecting an unoccupied cage and tentatively setting the standby position thereof, so as to predict the position of unoccupied cages after the lapse of the predetermined time under the condition that the detected unoccupied cage is run to the set position and is caused to stand by there, predicting, from the positions of the cages, the number of cages which will lie in certain floors or certain floor zones after the lapse of the predetermined time and estimating the numbers of cages in association with the floors, whereby the floor in which the unoccupied cage is to stand by is selected.

7 Claims, 11 Drawing Sheets

GROUP-SUPERVISING AN ELEVATOR SYSTEM

BACKGROUND OF THE INVENTION

This invention relates to a method of group-supervising an elevator system where a plurality of cages are controlled so as to stand by.

In a case where a plurality of cages are juxtaposed, a group supervision operation is usually performed. One system of the group supervision operation is an assignment system. In this system, as soon as a hall call is registered, assignment estimation values are calculated for the respective cages, whereupon the cage of the best estimation value is selected and assigned as a cage to-serve, and only the assigned cage is caused to respond to the hall call, thereby intending to enhance the service efficiency of the elevator system and to shorten the wait times of hall calls. Besides, in order to make the assignment system efficient, cages (hereinbelow, termed "unoccupied cages") which have responded to cage calls and allotted hall calls and have completed their services are caused to dispersively stand by at proper floors. There are the following schemes for the dispersive standby:

(a) The service floors of a building or an elevator system are divided into a plurality of blocks, in each of which one cage or two cages is/are caused to stand by in accordance with predetermined priority levels. (Official gazettes of Japanese Patent Applications Laid-open No. 73755/1978, No. 56958/1980 and No. 111373/1980, and so on)

(b) The arrival expectation times of cages for arriving at a specified floor are compared with a predetermined period of time set in correspondence with the specified floor, thereby to decide if an unoccupied cage which can arrive within the predetermined time and which is standing by is existent. In the absence of the unoccupied cage which is standing by, the unoccupied cage is moved to, and caused to stand by in, either of the specified floor and a floor from which the cage can arrive at the specified floor within the predetermined time. (Official gazette of Japanese Patent Application Publication No. 37187/1986)

(c) An unoccupied cage is moved to stand by in a floor which is nearest to the middle point of the longest one of the cage intervals between other cages except for the unoccupied cage. (Official gazette of Japanese Patent Application Publication No. 17829/1982)

(d) Unoccupied cages are moved to stand by so that the intervals between the unoccupied cages or between floors in which the cages stop may become a predetermined value or less. (Official gazette of Japanese Patent Application Laid-open No. 48366/1984)

(e) Traffic volumes in a building (the numbers of persons getting on and off) are collected for individual floors, floors in which cages stand by and numbers in which the cages stand by are determined according to the traffic demands, and the cages are caused to dispersively stand by on the basis of-the standby floors as well as the standby cage numbers. (Official gazette of Japanese Patent Application Laid-open No. 138580/1984)

(f) The numbers of hall calls registered are collected, and floors where more hall calls occur are determined as standby floors, in which cages are caused to dispersively stand by. (Official gazette of Japanese Patent Application Laid-open No. 62176/1982)

The above schemes, however, involve problems as stated below:

With the scheme (a), unless the dispersive standby floor has one standby cage (two cages in each of some floors) corresponding thereto, a cage standing by in another floor is drawn to the standby floor. Accordingly, this cage is specially run to the standby floor even when a cage exists near the pertinent standby floor. Such an operation becomes a wasteful run, and incurs a useless power consumption. Therefore, the scheme (b) has been proposed, and when the cage exists near enough to arrive at the standby floor within the predetermined time, it need not be specially run to the standby floor. In a case where all the cages of the elevator system are unoccupied cages, it is satisfactory that, as in the scheme (a) or (b), the cages of the plurality of blocks (zones) are individually caused to dispersively stand by in accordance with the predetermined priority levels. However, in a case where any cage is operating in response to the cage call or the allotted hall call, it is difficult to say that the dispersive standby conforming to the priority levels is always appropriate. It becomes important to predict the movement of the operating cage in the near future and to select on the basis of the prediction the standby floors in which the unoccupied cages are to stand by.

This point will be explained with reference to FIG. 13. It is assumed that a building in which three cages are installed is divided into three zones $Z_1$, $Z_2$ and $Z_3$ as illustrated in FIG. 13, and that unoccupied cages are caused to dispersively stand by in accordance with the priority levels of $Z_1 \rightarrow Z_3 \rightarrow Z_2$. It is also assumed that the cages A and B are unoccupied, whereas the cage C is operating in order to respond to the down call $\mathbf{6}_d$ of the sixth floor and the cage call $\mathbf{1}_c$ of the first floor. When the scheme (a) is applied on this occasion, the cages A and B are respectively caused to dispersively stand by in the zones $Z_1$ and $Z_3$ in spite of the situation that the cage C operating toward the zone $Z_1$ can respond in the shortest time to a hall call which will occur near the first floor in the near future. Accordingly, the cages A and C will stand by in the first floor together after 20 odd seconds, and the dispersive standby operation is not effective for shortening the wait time of the hall call. Eventually, the cage A or C is run to stand by in the zone $Z_2$, and useless power is consumed again as stated before. The same problem is left unsolved in the scheme (b).

In addition, there are schemes wherein, as in the schemes (c) and (d), the standby floors are determined so as to establish uniform cage intervals. However, while any cage is operating in order to respond to a call, the cage intervals change every moment, and hence, the standby floors must be changed in conformity with the changing intervals. Thus, the problem of increased wasteful runs is not solved. Further, there are schemes wherein, as in the schemes (e) and (f), the floors in which hall calls are liable to occur, or floors which are near the former floors are determined as the standby floors. It is wasteful, however, that the unoccupied cage is caused to stand by in spite of the presence of the cage operating toward the pertinent floor as explained with reference to FIG. 13. Moreover, although the hall call is liable to occur, the occurrence is random. Therefore, in a case where a hall call occurs earlier at another floor, the wait time of this hall call may possibly become long.

In this manner, in the case where one or more cages are operating in order to respond to the calls in the mode of the dispersive standby of the unoccupied cages, the prior-art schemes have the problems of the prolonged wait times and increased wasteful runs.

There has also been proposed a scheme (g) as stated below wherein, when a hall call has occurred anew with all cages standing by as unoccupied cages, floors in which the respective cages will become unoccupied in the future when assigned to the hall call are predicted, and that an appropriate one of the cages which will establish the state of the dispersive arrangement of the cages also after the end of its service to the hall call is selected and is assigned to the hall call. This assignment scheme is intended to dispense with the dispersive standby operation after the end of the service and to prevent the wasteful operations of the unoccupied cages.

(g) A group-supervisory elevator system wherein cages are caused to stand by at alighting positions when a hall call has occurred anew, the hall call is tentatively allotted to each of the cages in succession so as to predict the alighting position of the tentatively assigned cage, the degree of dispersion of the cages is calculated from the predicted alighting position of the tentatively assigned cage and the positions of the other cages, such degrees of dispersion are used as estimation values of the respective assigned cages so that the cage affording a higher degree of dispersion may be assigned more easily, and the cage to be assigned to the hall call is determined from the estimation values of the respective cages. (Official gazette of Japanese Patent Application Publication No. 56076/1987)

However, the assignment scheme as stated above, which is intended to control the cages at the occurrence of the hall call so that the cage arrangement in the future (the cage arrangement at the point of time at which the tentatively assigned cage is alighted from) may become appropriate, is applicable only in the limited situation where the hall call has occurred and where all the cages are unoccupied cages. In particular, when an unexpected hall call occurs anew before obtaining the result of the last hall call allotment (that is, before the realization of the cage arrangement as expected), the last hall call allotment prolongs the wait time of the new hall call. Accordingly, it is readily conjectured that the wait time of a hall call within a predetermined period of time will consequently lengthen. As thus far described, it is unreasonable to substitute the hall call allotment for the function of the dispersive standby operation, and it is necessary for shortening the wait time to disperse the unoccupied cages for standby before the occurrence of the hall call.

SUMMARY OF THE INVENTION

This invention has been made in order to solve the aforementioned problems in the operation of dispersive standby, and has for its object to provide a method of group-supervising an elevator system in which the variation of cage arrangement with the lapse of time is accurately grasped for the dispersive standby of unoccupied cages, thereby making it possible to shorten the wait time of a hall call and reduce the number of wasteful runs of the cages in the near future with respect to the present point in time.

A method of group-supervising an elevator system according to this invention comprises the steps of predicting the situation of operating cages after the lapse of a predetermined time; detecting an unoccupied cage and tentatively setting a standby position thereof so as to predict the situation of unoccupied cages after the lapse of a predetermined time under the condition that the detected unoccupied cage is run to the set position and is caused to stand by these; predicting from the situations of the cages the number of cages which will lie at certain floors or certain floor zones after the lapse of the predetermined time; and estimating the numbers of cages in association with the floors or the like, whereby the floor at which the unoccupied cage is to stand by is selected.

With the method of group-supervising an elevator system according to this invention, when the unoccupied cage is detected, the position at which the unoccupied cage is to stand by is tentatively set, the number of cages which will lie at the certain floors or the certain floor zones after the lapse of the predetermined time are predicted, and the floor at which the unoccupied cage is to dispersively stand by is selected by estimating the predicted, values in association with the floors or the like.

BRIEF DESCRIPTION OF THE DRAWINGS

FIGS. 1–11 are diagrams showing an embodiment of a method of group-supervising an elevator system according to this invention, in which:

FIG. 1 is a block diagram of the whole apparatus for performing the group supervision method;

FIG. 2 is a block circuit diagram of a group supervision device (10);

FIG. 3 is a flow chart of a group supervision program;

FIG. 4 is a flow chart of an unoccupied cage detection program;

FIG. 5 is a flow chart of a standby operation program;

FIG. 6 is a flow chart of a cage position prediction program;

FIG. 7 is a flow chart of a cage number prediction program;

FIG. 8 is a flow chart of a standby limitation program;

FIG. 9 is a diagram showing the zonal division of a building; and

FIGS. 10 and 11 are diagrams each showing the relationship between calls and cage positions.

Throughout the drawings, the same symbols indicate identical or equivalent portions.

DESCRIPTION OF THE PREFERRED EMBODIMENTS

FIGS. 1–11 are diagrams showing an embodiment of this invention. In this embodiment, it is assumed that three cages are installed in a 12-storeyed building.

Figure 1:
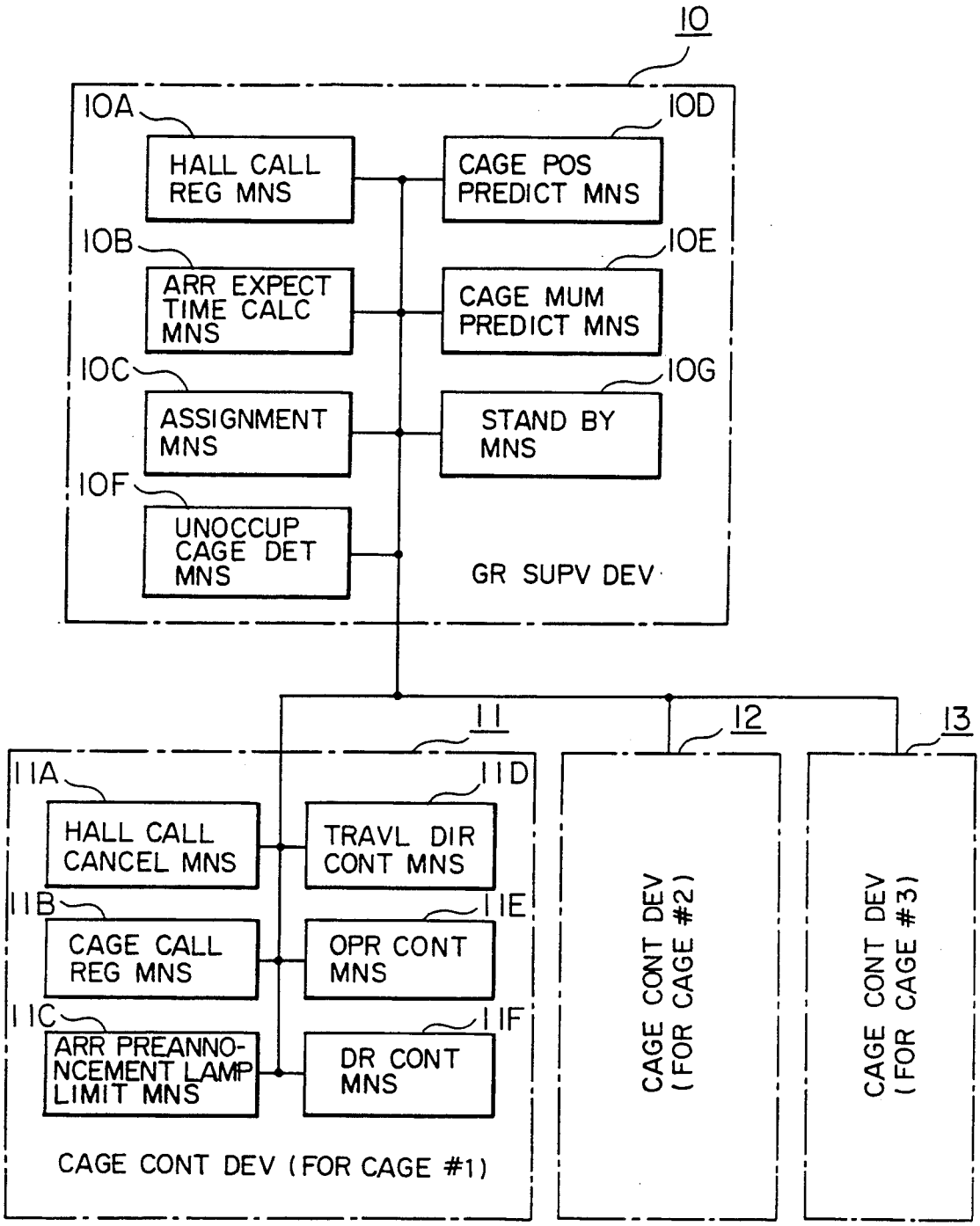

FIG. 1 is a functional block diagram of the whole apparatus for use in the embodiment. The apparatus is constructed of a group supervision device 10, and cage control devices 11–13 for the respective cages No. 1–No. 3 and are controlled by the device 10.

The group supervision device 10 includes hall call registration means 10A for registering and cancelling the hall calls (up call and down call) of each floor and for calculating a period of time elapsed since the registration of the hall call, namely, a continuation time; arrival expectation time calculation means 10B for calculating the predictive value of a period of time required for each cage to arrive at the hall of the pertinent floor (in each individual direction), namely, an arrival expectation time; and assignment means 10C for selecting and assigning one cage best to serve the hall call, this means executing an assignment calculation on the basis of the predictive wait time (=the continuation time+the arrival expectation time) of the hall call. The device 10 further includes cage position prediction means 10D for calculating the position and direction of each cage after the lapse of a predetermined period of time T as a prediction; cage number prediction means 10E for calculating the number of cages which will lie in each predetermined floor zone after the lapse of the predetermined time T as a prediction, on the basis of the predicted cage positions and the predicted cage directions; unoccupied cage detection means 10F for detecting the cage which has responded to cage calls and the allotted hall calls; and standby means 10G for causing the unoccupied cage to stand by in a specified floor or the floor in which the cage has ended the responses to the calls, on the basis of the predicted numbers of cages.

The cage control device 11 for the cage No. 1 is provided with hall call cancellation means 11A for delivering a hall call cancellation signal corresponding to the hall call of each floor, cage call registration means 11B for registering the cage call of each floor, arrival preannouncement lamp limitation means 11C for limiting the lighting of the arrival preannouncement lamps (not shown) of each floor, traveling direction control means 11D for determining the traveling direction of the cage, drive control means 11E for controlling the run and stop of the cage in order to respond to the cage call and the allotted hall call, and door control means 11F for controlling the opening and closure of the door of the cage. Incidentally, each of the cage control devices 12 and 13 for the respective cages No. 2 and No. 3 is constructed similarly to the cage control device 11 for the cage No. 1.

Figure 2:
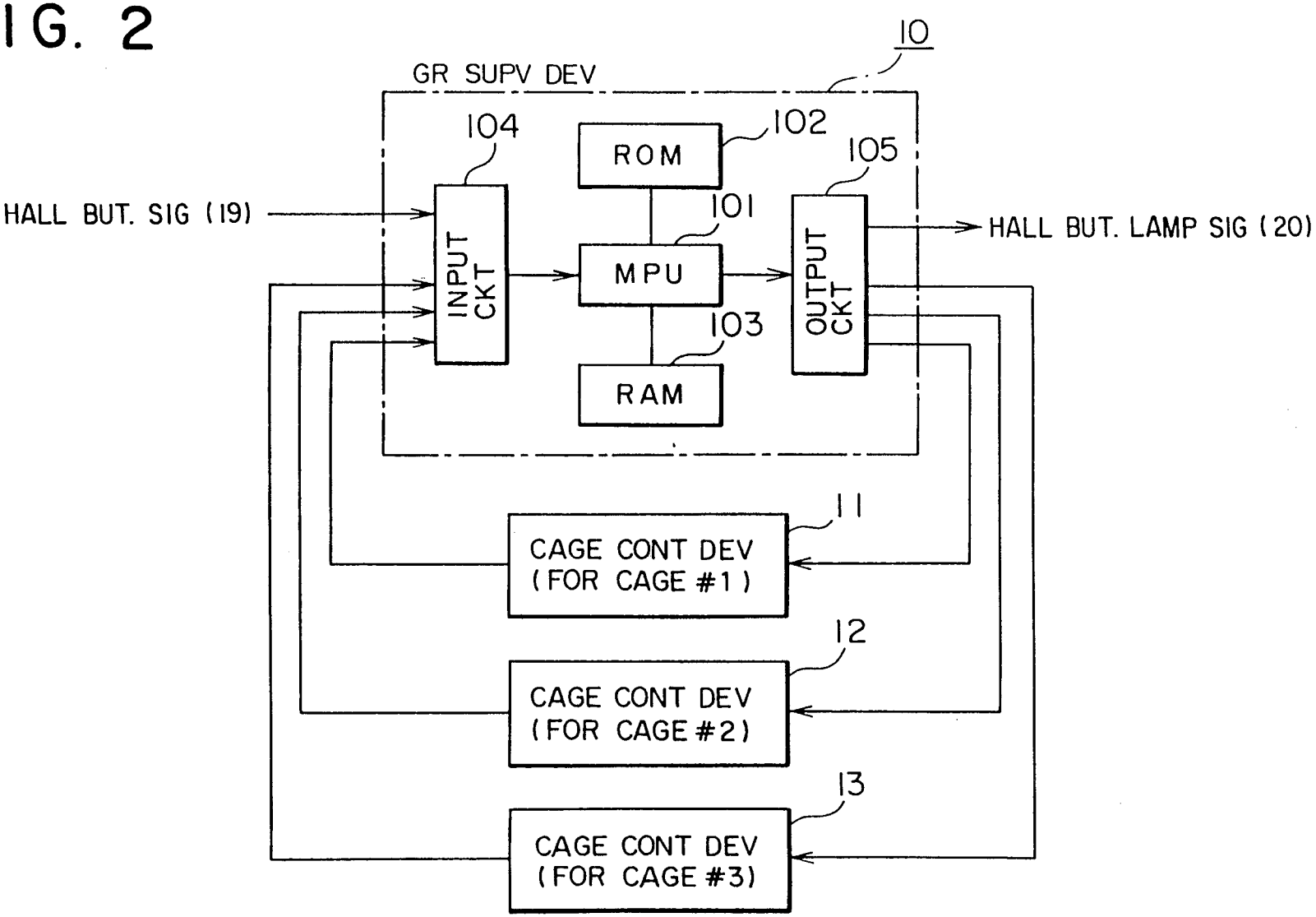

FIG. 2 is a block circuit diagram of the group supervision device 10. This group supervision device 10 is constructed of a microcomputer, which includes an MPU (microprocessing unit) 101, a ROM 102, a RAM 103, an input circuit 104 and an output circuit 105. The input circuit 104 is supplied with hall button signals 19 from the hall buttons of the respective floors, and the state signals of the cages Nos. 1–3 from the respective cage control devices 11–13. The output circuit 105 delivers signals 20 to hall button lamps built in hall buttons, and command signals to the cage control devices 11–13.

Figure 3:
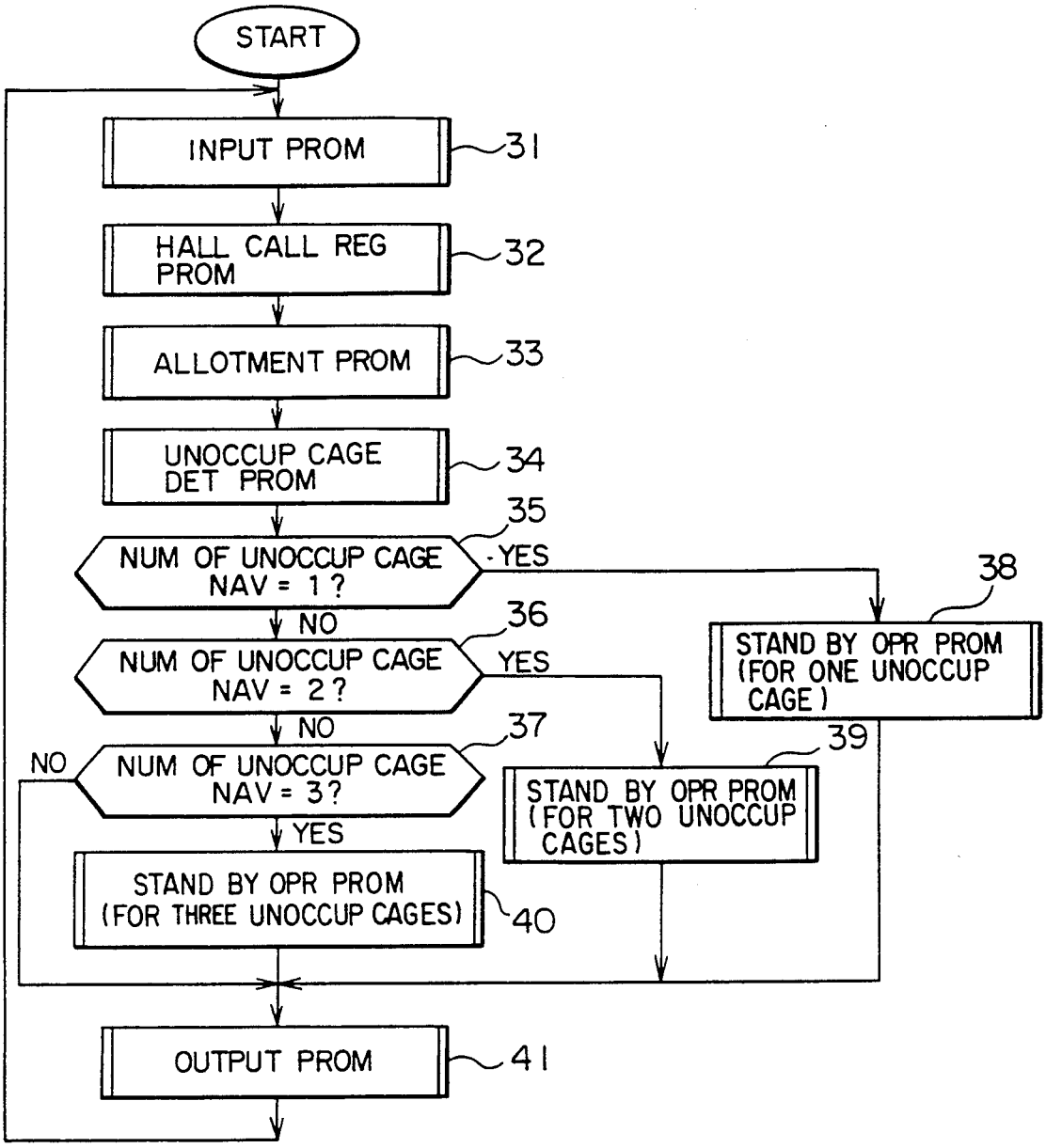
Figure 4:
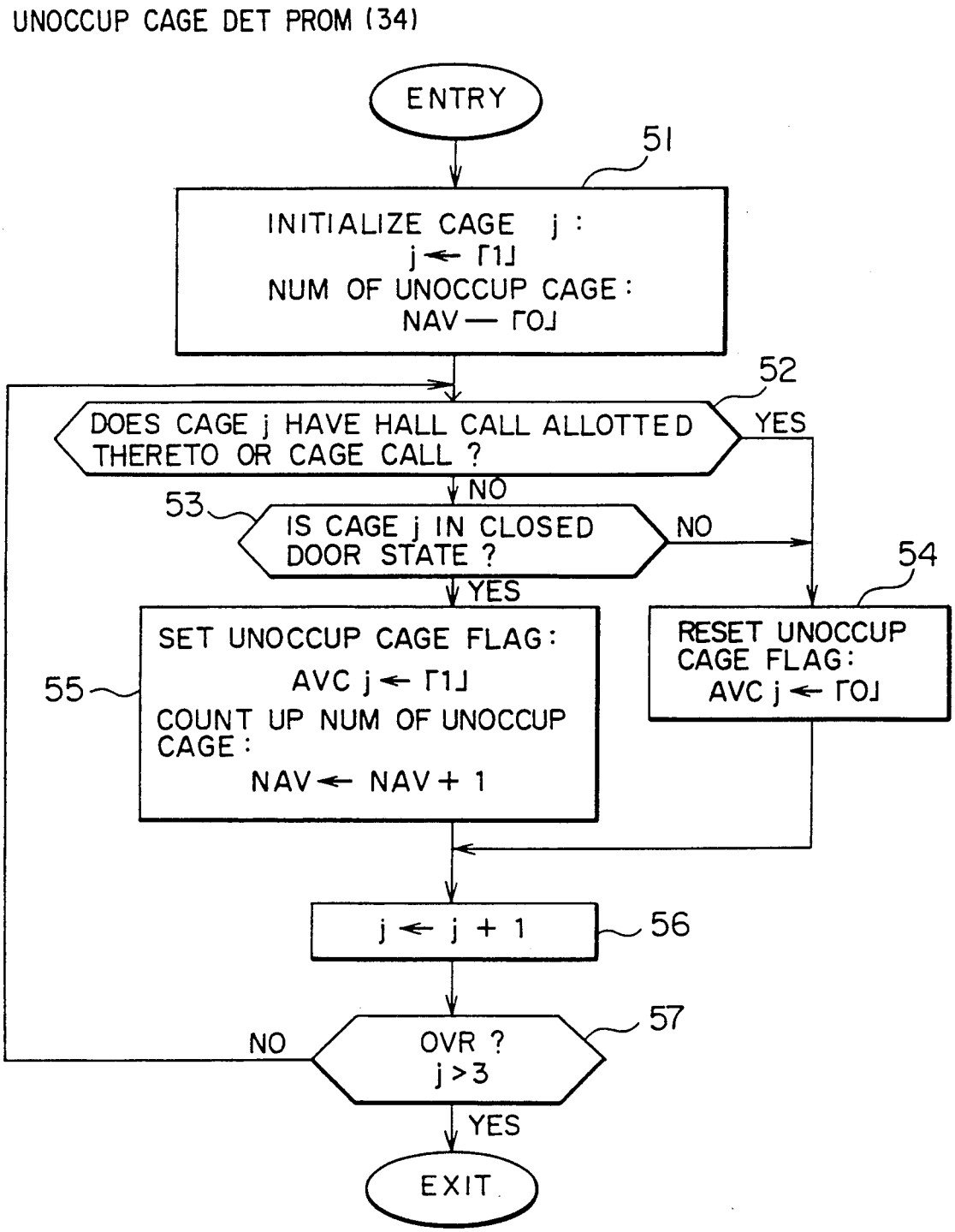
Figure 5:
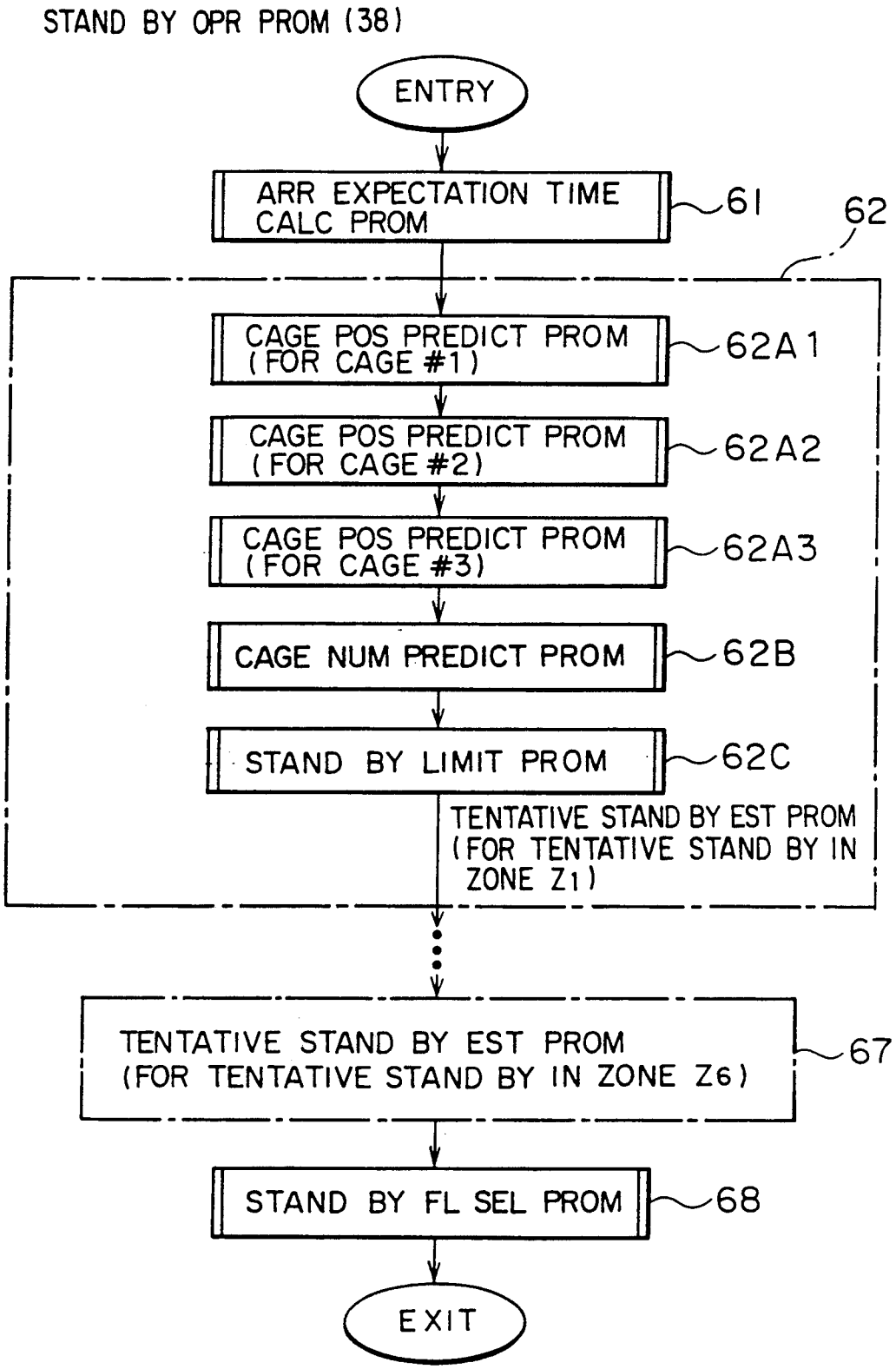
Figure 6:
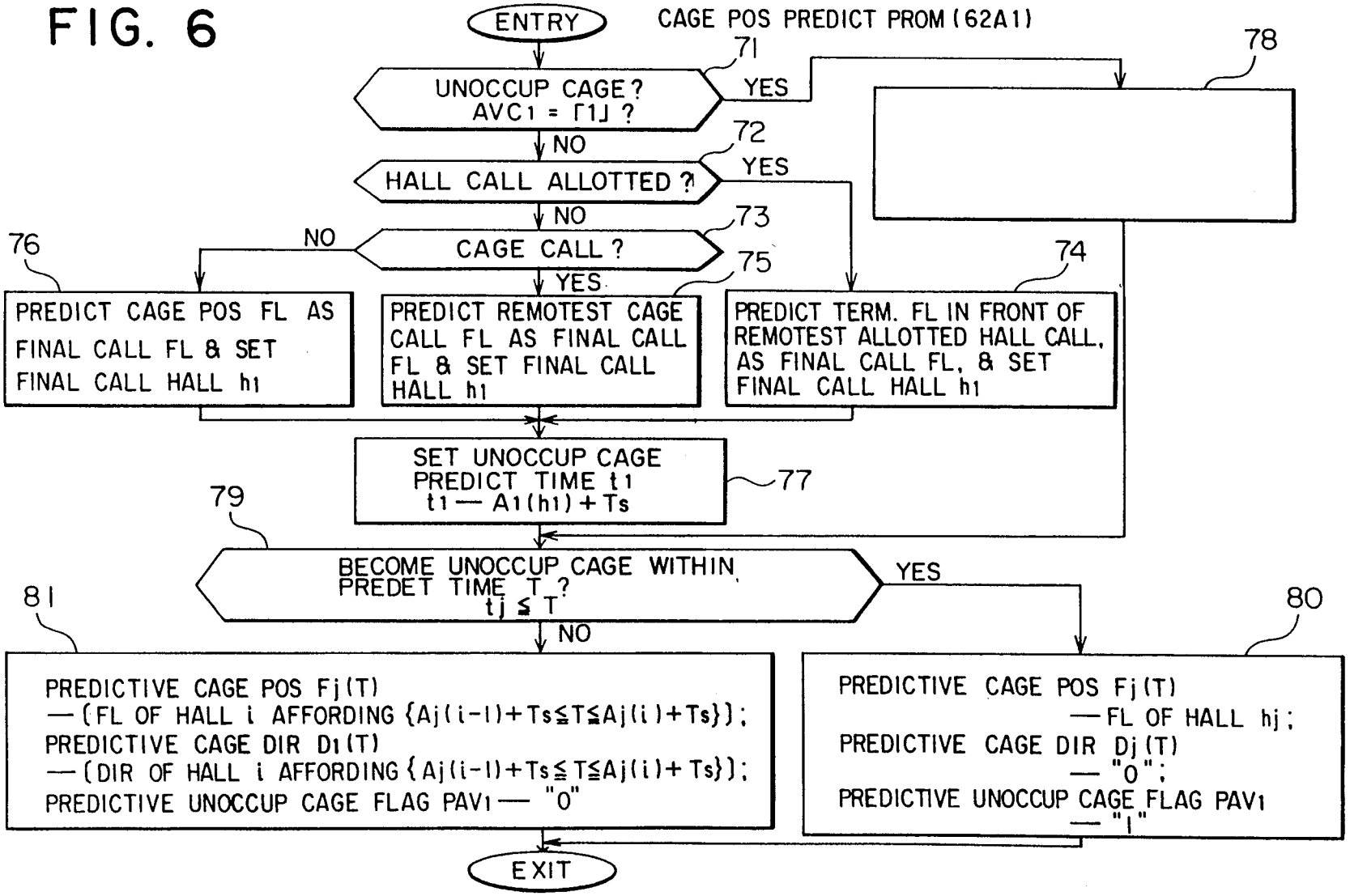
Figure 7:
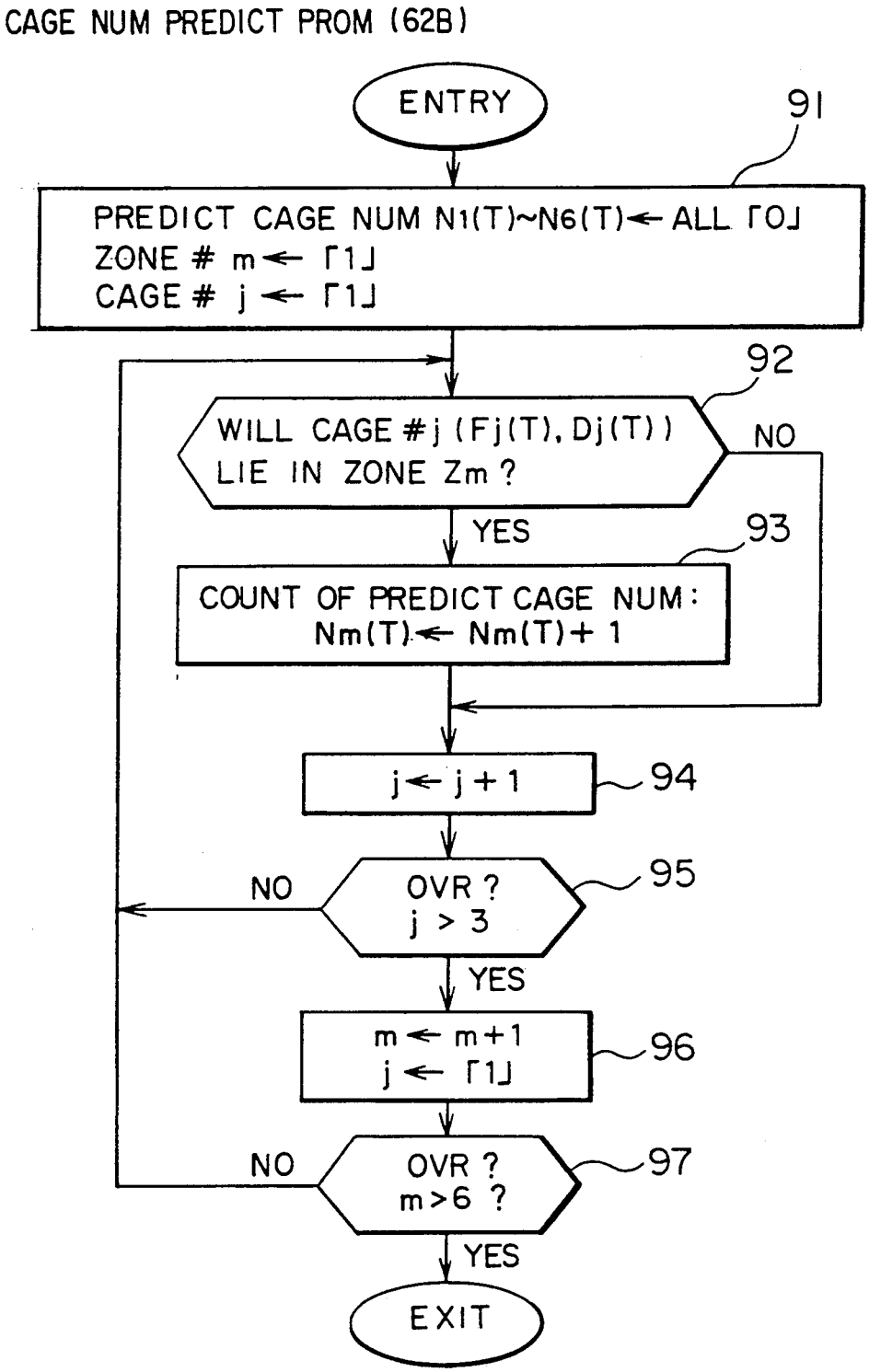
Figure 8:
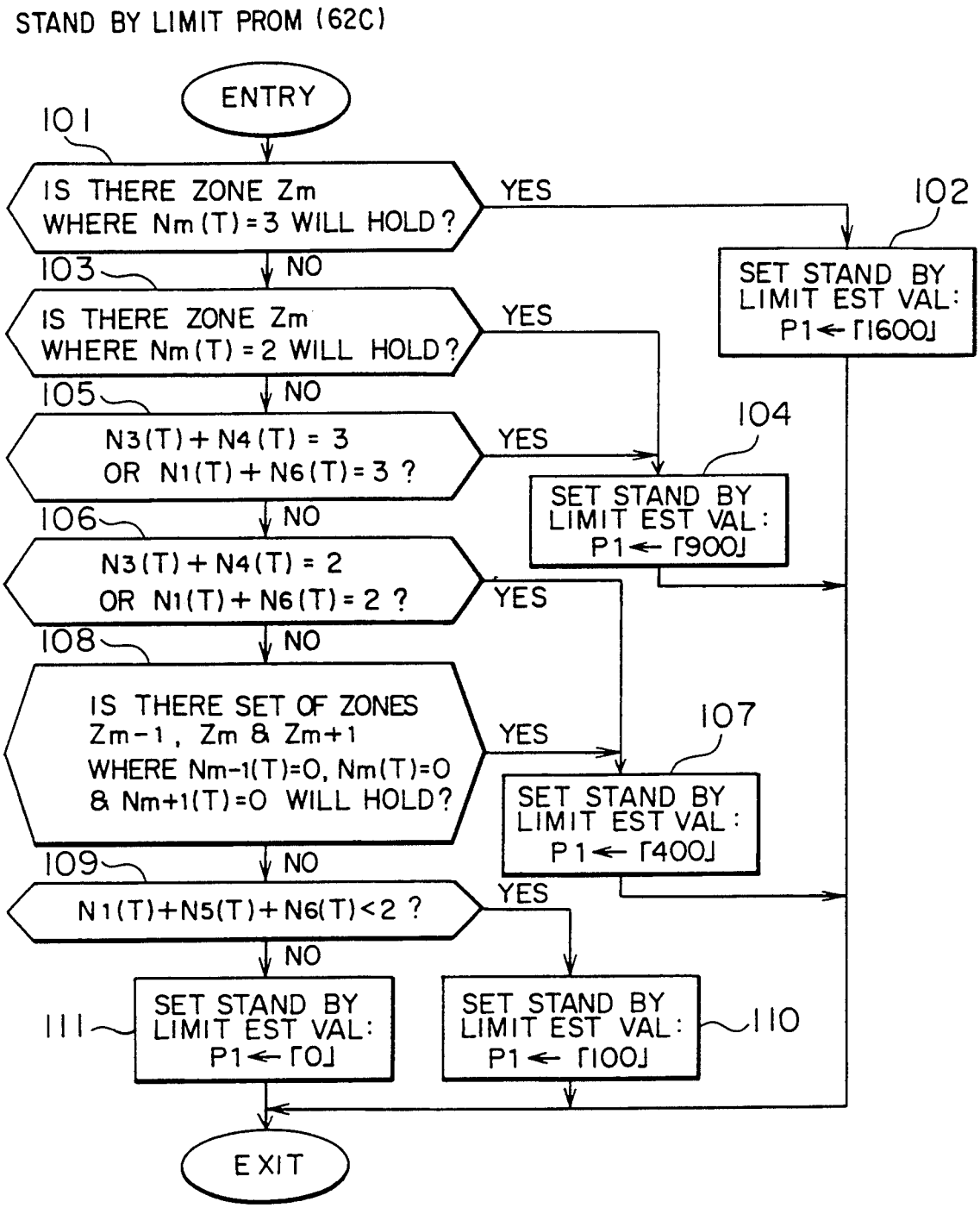
Figure 9:
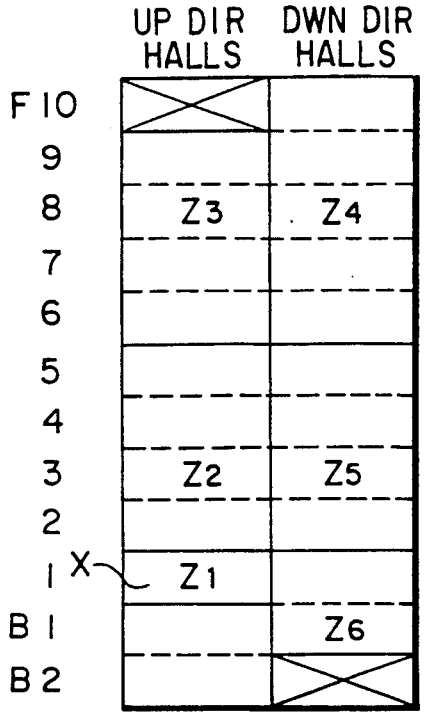

Next, the operation of this embodiment will be described with reference to FIGS. 3–9. FIG. 3 is a flow chart showing a group supervision program which is stored in the ROM 102 of the microcomputer constructing the group supervision device 10. FIG. 4 is a flow chart showing an unoccupied cage detection program. FIG. 5 is a flow chart showing standby operation steps in the case of one unoccupied cage. FIG. 6 is a flow chart showing a cage position prediction program in the standby operation steps. FIG. 7 is a flow chart showing a cage number prediction program in the standby operation steps. FIG. 8 is a flow chart showing a standby limitation calculation program in the standby operation steps. FIG. 9 is a diagram showing the state in which the building is divided into a plurality of floor zones.

First, the group supervision method will be outlined with reference to FIG. 3.

An input program at a step 31 applies as inputs the hall button signals 19, and the state signals from the cage control devices 11–13 (the positions and directions of the cages, the stopped or running states of the cages, the open or closed states of the doors, the loads of the cages, the cage calls, the hall call cancellation signals, etc.).

A hall call registration program at a step 32 registers and cancels the hall calls, decides the lighting and extinction of the hall button lamps, and calculates the continuation times of the hall calls.

An allotment program at a step 33 is such that, when a hall call C is registered anew, it is tentatively allotted to the cages Nos. 1–3 to calculate respective wait time estimation values $W_1$–$W_3$ on this occasion, whereupon the cage having the minimum value among the wait time estimation values $W_1$–$W_3$ is selected as a regular assigned cage. Since the calculations of the wait time estimation values $W_1$–$W_3$ are well known, they shall not be described in detail. By way of example, when the cage No. 1 is tentatively assigned to the hall call C, the predictive wait times U(i) of respective hall calls i (i=1, 2, . . . , and 22: "0" second is set when the corresponding hall call is not registered) are evaluated, and the wait time estimation value is given by the summation of the squared values of the predictive wait times; $W_1=U(1)^2+U(2)^2+\ldots+U(22)^2$. The wait time estimation values $W_2$ and $W_3$ are similarly calculated.

The unoccupied cage detection program at a step 34 detects the unoccupied cage being a cage which has responded to all of the cage calls and the allotted hall calls and which is standing by with its door closed. This operation will be described in detail with reference to FIG. 4.

In the unoccupied cage detection program 34 shown in FIG. 4, at a step 51, cage No. j is initialized to "1", and a counter NAV for the number of unoccupied cages is initialized to "0". A step 52 decides whether or not the cage j has any allotted hall call or any cage call. If the cage j has any call to be responded to, an unoccupied cage flag $AVC_j$ is reset to "0" at a step 54. If this cage does not have any call to be responded to, the step 52 is followed by a step 53, which decides whether or not the cage j is in the closed door state. If the cage j is not in the closed door state, the control flow proceeds to the step 54, at which the unoccupied cage flag $AVC_j$ is reset to "0". If this cage is in the closed door state, the step 53 is followed by a step 55, at which the unoccupied cage flag $AVC_j$ is set to "1", and the unoccupied cage number counter NAV is incremented by "1". In addition, the cage No. j is increased by "1" at a step 56. This step 56 is followed by a step 57, which decides whether or not all the cages have been processed. If the cage No. j is "3" or less, the control flow returns to the step 52 again, and similar processing is repeated for the next cage. When all the cages have been processed (cage No. j>3), the process of the unoccupied cage detection program 34 is ended.

Referring back to the group supervision program 10 in FIG. 3, when the process of the unoccupied cage detection program 34 has been ended, the numbers of unoccupied cages NAV are decided at steps 35–37, and standby operation programs 38–40 corresponding to the numbers of unoccupied cages NAV are executed. That is, the control flow proceeds along the steps 35→38 when the number of unoccupied cages NAV is "1", along the steps 35→36→39 when the number NAV is "2", and along the steps 35→36→37 →40 when the number NAV is "3". The standby operation program 38 in the case where the number of unoccupied cages NAV is "1", will be described in detail with reference to FIG. 5.

In the standby operation program 38 shown in FIG. 5, at the step of an arrival expectation time calculation program 61, arrival expectation times $A_j(i)$ for arriving at halls i (where i=1, 2, 3, . . . , and 11 denote the up direction halls of the respective floors B2, B1, F1, . . . , and F9, and i=12, 13, . . . , 21, and 22 denote the down direction halls of the respective floors F10, F9, . . . , F1, and B1) are calculated every cage j (j=1, 2, and 3). The arrival expectation times are calculated assuming, by way of example, that the cage expends 2 seconds on the run of one floor and 10 seconds on one stop and that it is driven up and down throughout all the halls in succession. The calculation of the arrival expectation times is well known.

At the next steps 62–67, estimations are done as to respective cases where the unoccupied cages are tentatively caused to stand by in floor zones $Z_1$–$Z_6$ each of which consists of one floor or a plurality of successive floors as indicated in FIG. 9. In the cage position prediction programs 62A1–62A3 of the tentative standby estimation program 62, the predictive cage positions $F_1(T)$ –$F_3(T)$ and predictive cage directions $D_1(T)$–$D_3(T)$ of the cages No. 1–No. 3 after the lapse of a predetermined period of time T, in the case of tentatively causing the unoccupied cage (any of the cages No. 1–No. 3) to stand by in the floor X (=F1) within the zone $Z_1$, are predictively calculated for the respective cages. The cage position prediction program 62A1 for the cage No. 1 will be described in detail with reference to FIG. 6.

In the cage position prediction program 62A1 for the cage No. 1 as shown in FIG. 6, the first step 71 decides whether or not the cage No. 1 is unoccupied cage. If the cage No. 1 is the unoccupied cage ($AVC_1$="1"), a step 78 functions to predict the standby floor X as a final call floor and set a final call prediction hall $h_1$ and also functions to set $A_1(h_1)$ as an unoccupied cage prediction time $t_1$, and it is followed by a step 79. In contrast, if the cage No. 1 is not the unoccupied cage ($AVC_1$="0"), the step 71 is followed by a step 72. The presence or absence of an allotted hall call is decided at the step 72, and the presence or absence of a cage call is decided at a step 73. The final call prediction hall $h_1$, and the predictive value $t_1$ of a period of time required for the cage No. 1 to become the unoccupied cage (termed the "unoccupied cage prediction time) are set on the basis of the results of the decisions. When the cage No. 1 has the allotted hall call, the control flow proceeds from the step 72 to a step 74, at which the terminal floor in front of the remotest allotted hall call is predicted as the final call floor of the cage No. 1, and the predicted floor is set as the final call prediction floor $h_1$, considering also the arrival direction of the cage in that floor (down direction in the top floor, and up direction in the bottom floor). In addition, when the cage No. 1 has only the cage call without having the allotted hall call, the control flow proceeds along the step 72→ the step 73→ a step 75, at which the remotest cage call floor is predicted as the final call floor of the cage No. 1, and the predicted floor is set as the final call prediction hall $h_1$, considering also the arrival direction of the cage on that occasion. Further, when the cage No. 1 has neither the allotted hall call nor the cage call, the control flow proceeds along the step 72→ the step 73→ a step 76, at which the cage position floor of the cage No. 1 is predicted as the final call floor, and the predicted floor is set as the final call prediction hall $h_1$, considering also the cage direction on that occasion.

When the final call prediction hall $h_1$ has been found in this way, the unoccupied cage prediction time $t_1$ of the cage No. 1 is subsequently evaluated at a step 77. The unoccupied cage prediction time $t_1$ is obtained in such a way that the predictive value $T_s$ (=10 seconds) of the stop time of the cage at the final call prediction hall $h_1$ is added to the arrival expectation time $A_1(h_1)$ for arriving at the hall $h_1$. Incidentally, in the case where the cage position floor has been set as the final call prediction hall $h_1$, the remaining time of the stop time is predicted in accordance with the states of the cage (a running state, a decelerating state, a door opening state, an open door state, a door closing state, etc.), and it is set as the unoccupied cage prediction time $t_1$.

Subsequently, the predictive cage position $F_1(T)$ and predictive cage direction $D_1(T)$ of the cage No. 1 after the predetermined time T are calculated at steps 79–81. Here, the "predetermined time T" is set for the prediction of the near future, and a favorable service can be produced by selecting an average wait time (about 20 seconds) by way of example. When the unoccupied cage prediction time $t_1$ of the cage No. 1 is not greater than the predetermined time T, it is signified that the cage No. 1 will become the unoccupied cage upon or before the lapse of the predetermined time T. Therefore, the control flow proceeds along the steps 79→80, at which the floor of the hall h is set as the predictive cage position $F_1(T)$ after the lapse of the predetermined time T on the basis of the final call prediction hall $h_1$. In addition, the predictive cage direction $D_1(T)$ is set at "0". As the predictive cage direction $D_1(T)$, "0" expresses no direction, "1" the up direction, and "2" the down direction. Further, a predictive unoccupied cage flag PAV is set at "1".

In contrast, when the unoccupied cage prediction time $t_1$ of the cage No. 1 is greater than the predetermined time T, it is signified that the cage No. 1 will not become the unoccupied cage yet upon the lapse of the predetermined time T. Therefore, the control flow proceeds along the steps 79→81, Here, the floor of the hall i as to which the arrival expectation time $A_1(i-1)$ of the hall (i−1) and the arrival expectation time $A_1(i)$ of the hall i afford $\{A_1(i-1)+T_s \leqq T < A_1(i)+T_s\}$ is set as the predictive cage position $F_1(T)$ after the lapse of the predetermined time T, and the same direction as that of the hall i is set as the predictive cage direction $D_1(T)$. In addition, the predictive unoccupied cage flag $PAV_1$ is set at "0".

Thus, the predictive cage position $F_1(T)$, predictive cage direction $D_1(T)$ and predictive unoccupied cage flag $PAV_1$ for the cage No. 1 are calculated by the unoccupied cage prediction program 62A1. The predictive cage positions $F_2(T)$ and $F_3(T)$, predictive cage directions $D_2(T)$ and $D_3(T)$ and predictive unoccupied cage flags $PAV_2$ and $PAV_3$ for the cages No. 2 and No. 3 are respectively calculated by the unoccupied cage prediction programs 62A2 and 62A3 each of which consists of steps similar to those of the unoccupied cage prediction program 62A1.

Referring back to FIG. 5, in the cage number prediction program 62B for the tentative standby in the zone $Z_1$, predictive cage numbers $N_1(T)$–$N_6(T)$ in the zones $Z_1$–$Z_6$ after the lapse of the predetermined time T are respectively calculated under the condition that the unoccupied cage is tentatively caused to stand by in the standby floor X within the zone $Z_1$. This operation will be described in detail with reference to FIG. 7.

In the cage number prediction program 62B shown in FIG. 7, at a step 91, all the predictive cage numbers $N_1(T)$–$N_6(T)$ are initialized to "0", and the cage No. j and zone No. m are respectively initialized to "1". On the basis of the predictive cage position $F_j(T)$ and predictive cage direction $D_j(T)$ of the cage No. j, a step 92 decides whether or not the cage No. j will lie in the zone $Z_m$ after the lapse of the predetermined time T. When the cage No. j is predicted to lie in the zone $Z_m$, a step 93 increases the predictive cage number $N_m(T)$ of the zone $Z_m$ by one. The cage No. j is increased by one at a step 94, and whether or not all the cages have been decided is checked at a step 95. If all the cages have not been decided, the control flow returns to the step 92, and the above processing is repeated.

When all the cages have undergone the processing of the steps 92 and 93 as to the zone $Z_m$ of the zone No. m, a step 96 subsequently increases the zone No. m by one and initializes the cage No. j to "1". Likewise, the processing of the steps 92–95 is repeated until the cage No. $j>3$ holds. When the above processing has been ended as to all the zones $Z_1$–$Z_6$, the zone No. $m>6$ holds at a step 97, and the process of the cage number prediction program 62B is ended.

In the standby limitation program 62C of the standby operation program 38 shown in FIG. 5, a standby limitation estimation value $P_1$ which serves to render the unoccupied cage difficult of standing by in the floor X of the zone $Z_1$ is calculated on the basis of the predictive cage numbers $N_1(T)$ –$N_6(T)$. Here, the standby limitation estimation value $P_1$ is set at a larger value as the cages are more liable to gather together in one place. The standby limitation operation will be described in detail with reference to FIG. 8.

In the standby limitation program 62C shown in FIG. 8, a step 101 decides whether or not there is the zone $Z_m$ in which the predictive cage number $N_m(T)=3$ will hold, that is, whether or not all the cages will gather together in one zone. When such a zone exists, the standby limitation estimation value $P_1$ is set to the maximum value "1600" at a step 102. In addition, a step 103 decides whether or not there is the zone $Z_m$ in which the predictive cage number $N_m(T)=2$ will hold, that is, whether or not most of the cages will gather together in one zone. When such a zone exists, the standby limitation estimation value $P_1$ is set to "900" at a step 104.

Further, a step 105 decides if all the cages will concentrate in the upper floors (the zones $Z_3$ and $Z_4$) or in the lower floors (the zones $Z_1$ and $Z_6$) ($N_3(T)+N_4(T)=3$ or $N_1(T)+N_6(T)=3$). When all the cages will concentrate, the standby limitation estimation value $P_1$ is similarly set to "900" at the step 104. Further, a step 106 similarly decides if most of the cages will concentrate in the upper floors or in the lower floors ($N_3(T)+N_4(T)=2$ or $N_1(T)+N_6(T)=2$). When most of the cages will concentrate, the standby limitation estimation value $P_1$ is set to "400" at a step 107.

Subsequently, a step 108 decides if there is a combination in which the predictive cage numbers $N_{m-1}(T)$, $N_m(T)$ and $N_{m+1}(T)$ of three adjacent zones $Z_{m-1}$, $Z_m$ and $Z_{m+1}$ will all become "0". When the set of such zones $Z_{m-1}$, $Z_m$ and $Z_{m+1}$ exists, the standby limitation estimation value $P_1$ is similarly set to "400" at the step 107.

Lastly, a step 109 decides whether or not at least two cages will exist($N_1(T)+N_5(T)+N_6(T)<2$) in the main floor (F1) and floors nearby (the zones $Z_1$, $Z_5$ and $Z_6$) in which there are many users. When at least two cages will not exist in and near the main floor, the standby limitation estimation value $P_1$ is set to "100" at a step 110, and when at least two cage will exist, the standby limitation estimation value $P_1$ is set to "0" at a step 111.

Thus, in the standby limitation program 62C, the standby limitation estimation value $P_1$ in the case of tentatively causing the unoccupied cage to stand by in the zone $Z_1$ is set on the basis of the predictive cage numbers $N_1(T)$–$N_6(T)$ in the respective zones $Z_1$–$Z_6$. Then, the estimation for the zone $Z_1$ by the tentative standby estimation program 62 is ended.

In the tentative standby programs 63–67 for the other zones $Z_2$–$Z_6$ as indicated in FIG. 5, estimations are similarly done to set standby limitation estimation values $P_2$–$P_6$, respectively.

When the standby limitation estimation values $P_1$–$P_6$ have been set as described above, one zone which has the minimum value among the standby limitation estimation values $P_1$–$P_6$ is selected by a standby floor selection program 68 included in the standby operation program 38 in FIG. 5. (Incidentally, when there are a plurality of zones which have the minimum value among the standby limitation estimation values $P_1$–$P_6$, only one of them shall be selected in accordance with predetermined priority levels. However, one of such zones may well be selected depending upon a different priority condition, for example, that a zone of the shortest traveling distance is preferentially selected.) Besides, when the final call floor of the unoccupied cage is included in the selected zone, a standby command is not set in order that the cage may stand by in the final call floor as it is. In contrast, when the final call floor of the unoccupied cage is not included in the selected zone, the standby command is set for the unoccupied cage in order that the unoccupied cage may be run to a specified floor in the selected zone and be caused to stand by therein.

The above is the processing of the standby operation program 38 in the case of the single unoccupied cage (the unoccupied cage number NAV ="1"). When the number of unoccupied cages is 2 or 3 (the unoccupied cage number NAV="2" or "3"), the standby operation program 39 or 40 in FIG. 3 is executed. In this case, standby limitation estimation values are found as to all the combinations of zones in which the unoccupied cages are tentatively caused to stand by, and zones in which the unoccupied cages are caused to stand by are determined in accordance with the combination of the tentative standby zones affording the minimum standby limitation estimation value, likewise to the calculations of the arrival expectation times, cage position prediction, cage number prediction and standby limitation estimation values in the standby operation program 38.

Lastly, in an output program at a step 41 shown in FIG. 3, the hall button lamp signals 20 set as described above are delivered to the halls, and assignment signals, preannouncement signals, the standby command, etc. are delivered to the cage control devices 11–13.

The group supervision program at numerals 31–41 is repeatedly executed in the way thus far described.

Next, the operation of the group supervision program 10 in this embodiment will be described more concretely with reference to FIGS. 10 and 11. For the sake of brevity, let's consider the case where the three cages A, B and C are installed in the building illustrated in FIG. 9.

Figure 10:
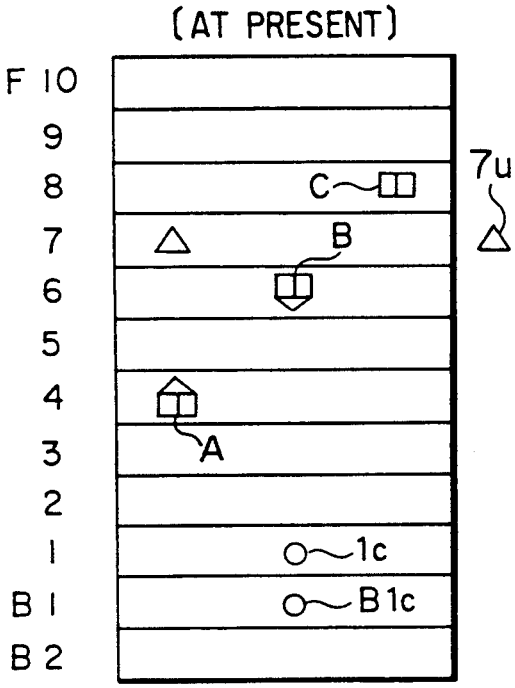

In FIG. 10, it is assumed that the up call $7_u$ of the 7th floor is allotted to the cage A traveling upwards, and that the cage call $1_c$ of the 1st floor and the cage call $B1_c$ of the 1st basement are registered in the cage B traveling downwards. The cage C is assumed to have just become an unoccupied cage.

Figure 11:
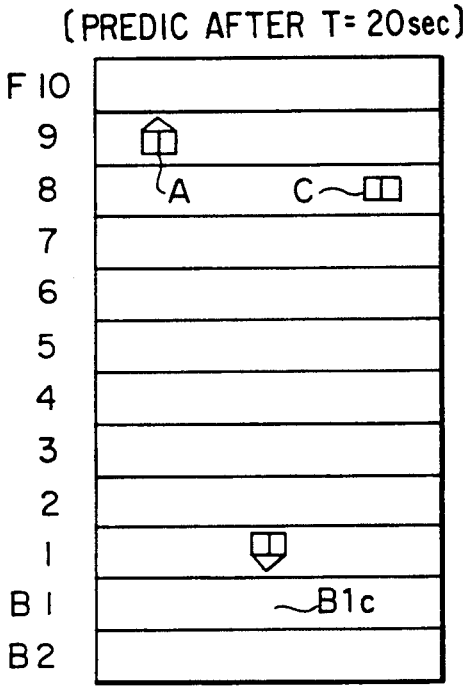

The positions of the cages after the lapse of the predetermined time T (=20 seconds) since the time of the situation of FIG. 10 are respectively predicted as shown in FIG. 11. Accordingly, the predictive cage numbers and the standby limitation estimation values in the case of tentatively causing the cage C to stand by in the standby floors of the respective zones $Z_1$–$Z_6$ become as tabulated below:

| Zones for Tentative Standby of Unoccupied Cage | Predictive Cage Numbers in Cases of Tentative Standby | | | | | | Standby Limitation Estimation Values |
|---|---|---|---|---|---|---|---|
| | $N_1$ (T) | $N_2$ (T) | $N_3$ (T) | $N_4$ (T) | $N_5$ (T) | $N_6$ (T) | |
| $Z_1$ | 1 | 0 | 1 | 0 | 0 | 1 | $P_1 = 400$ |
| $Z_2$ | 0 | 1 | 1 | 0 | 0 | 1 | $P_2 = 100$ |
| $Z_3$ | 0 | 0 | 2 | 0 | 0 | 1 | $P_3 = 900$ |
| $Z_4$ | 0 | 0 | 1 | 1 | 0 | 1 | $P_4 = 400$ |
| $Z_5$ | 0 | 0 | 1 | 0 | 1 | 1 | $P_5 = 100$ |
| $Z_6$ | 0 | 0 | 1 | 0 | 0 | 2 | $P_6 = 900$ |

Thus, the minimum value among the standby limitation estimation values $P_1$–$P_6$ is $P_2 = P_5 = 100$. Therefore, the zone $Z_2$ of younger zone No. is selected, and the standby command for standing by in the 4th floor which is the specified floor of the zone $Z_2$ is set for the cage C which is the unoccupied cage.

With the prior-art standby scheme, the cage C is caused to stand by in the standby floor (=1st floor) of the zone $Z_1$. Therefore, two of the cages will gather together in and near the 1st floor in the near future, and long wait calls will be liable to occur. In order to avoid such a situation, a standby operation must be performed again. In contrast, according to this invention, the unoccupied cage C is caused to stand by in the standby floor (=4th floor) of the zone $Z_2$ (or $Z_5$) in consideration of the cage arrangement after the lapse of the predetermined time T, so that the wasteful standby operation as mentioned above can be reduced.

As described above, in the present embodiment cage positions and cage directions which will arise when cages respond to calls in succession since the present point of time to elapse a predetermined time are predictively calculated, numbers of cages in respective zones after the lapse of the predetermined time are predictively calculated on the basis of the predicted cage positions and cage directions, and a standby operation is performed according to the predicted numbers of the cages. Therefore, the cages do not concentrate in one place, so that the wait times of hall calls can be shortened and wasteful runs can be reduced in the near future since the present point of time.

In the above embodiment, in predicting the cage position and cage direction after the lapse of the predetermined time T, a floor in which the cage will respond to the final call to become an unoccupied cage, and a period of time which is required till then are first predicted, whereupon the cage position and cage direction after the lapse of the predetermined time T are predicted. This is based on the assumption that, when the cage becomes unoccupied, it stands by in the floor without any further movement. In a case where the unoccupied cage is always caused to stand by in a specified floor, the cage position and cage direction may be predicted under the condition that the cage is run to the specified floor. Besides, in a traffic state in which the cage is less likely to become unoccupied, that is, which has a comparatively large traffic volume, the cage position and cage direction can be easily calculated and predicted under the condition that the cage does not become unoccupied even after the lapse of the predetermined time T, by omitting the calculations of an unoccupied cage prediction time and a final call prediction hall. Further, the cage position and cage direction can be predicted considering also a call which will occur anew before the lapse of the predetermined time T. Still further, the final call prediction hall may well be predicted accurately on the basis of the probabilities of occurrences of cage calls and hall calls evaluated statistically, unlike the simplified method of calculation as in this embodiment.

Although, in the above embodiment, a building has been divided into zones as illustrated in FIG. 9, it is also easy to sequentially alter the way of setting zones in accordance with time zones and the uses of respective floors (such as the main floor, a restaurant floor, a meeting room floor, and a relay floor) besides the number of floors and the number of installed cages. In addition, the directions of halls need not always be considered for determining the zones.

Further, in the above embodiment, standby limitation estimation values (>0) for selecting the most suitable standby floor have been respectively set in the following cases:

(1) Case of the setting of tentative standby in which the predictive number of cages in a predetermined zone becomes a prescribed value or greater.

(2) Case of the setting of tentative standby in which the predictive number of cages in a specified zone (upper floors or lower floors) becomes a prescribed value or greater.

(3) Case of the setting of tentative standby in which the predictive number of cages in a specified zone (the main floor) and zones nearby becomes less than a prescribed value.

(4) Case of the setting of tentative standby in which the predictive number of cages in a predetermined zone is 0, and besides, the predictive numbers of cages in adjacent zones are also 0. However, the setting conditions of the standby limitation estimation values based on the predictive numbers of cages are not restricted to the listed cases. Any conditions may be employed as long as whether or not cages will concentrate is decided using the predictive numbers of cages. In addition, the standby limitation estimation values are not restricted to fixed values such as "1600", "900", "400" and "100" as in the embodiment, but the setting conditions may well be expressed by a fuzzy set so as to determine the standby limitation estimation values on the basis of the membership function values thereof.

Further, in the embodiment, when two or more unoccupied cages exist, standby limitation estimation values are obtained as to all the combinations of zones in which the unoccupied cages are tentatively caused to stand by, and the standby floors of the unoccupied cages are respectively determined in accordance with the combination of the tentative standby zones minimizing the estimation values. However, the method of determining the standby floors in the presence of the two or more unoccupied cages is not restricted to this aspect. When the number of unoccupied cages is small, the above method has no problem, but when the number of unoccupied cages is large, the number of combinations becomes large, and hence, there arises the problem that a long calculation time is expended. Therefore, even in the case where the two or more unoccupied cages exist, the standby limitation estimation values are found under the conditions that only one cage is tentatively caused to stand by and that the remaining unoccupied cage or cages is/are caused to stand by at their floors left intact, and the standby floor of the unoccupied cage tentatively caused to stand by is determined. This processing is executed successively for all the unoccupied cages. It is obvious from the foregoing embodiment that such a system can be readily realized.

Moreover, means for selecting the standby floor of an unoccupied cage is not restricted to that of the above embodiment, but it may well be a system in which standby zones (standby floors) fulfilling standby limitation conditions are excluded from candidates for the standby floor beforehand. Considered as the system is, for example, one in which a standby zone having a large standby limitation estimation value is excluded from the candidate standby zone so that, from among standby zones having standby limitation estimation values smaller than a predetermined value, the regular standby floor may be selected according to a predetermined criterion (for example, the shortest running distance to the standby floor or the shortest arrival time).

Figure 12:
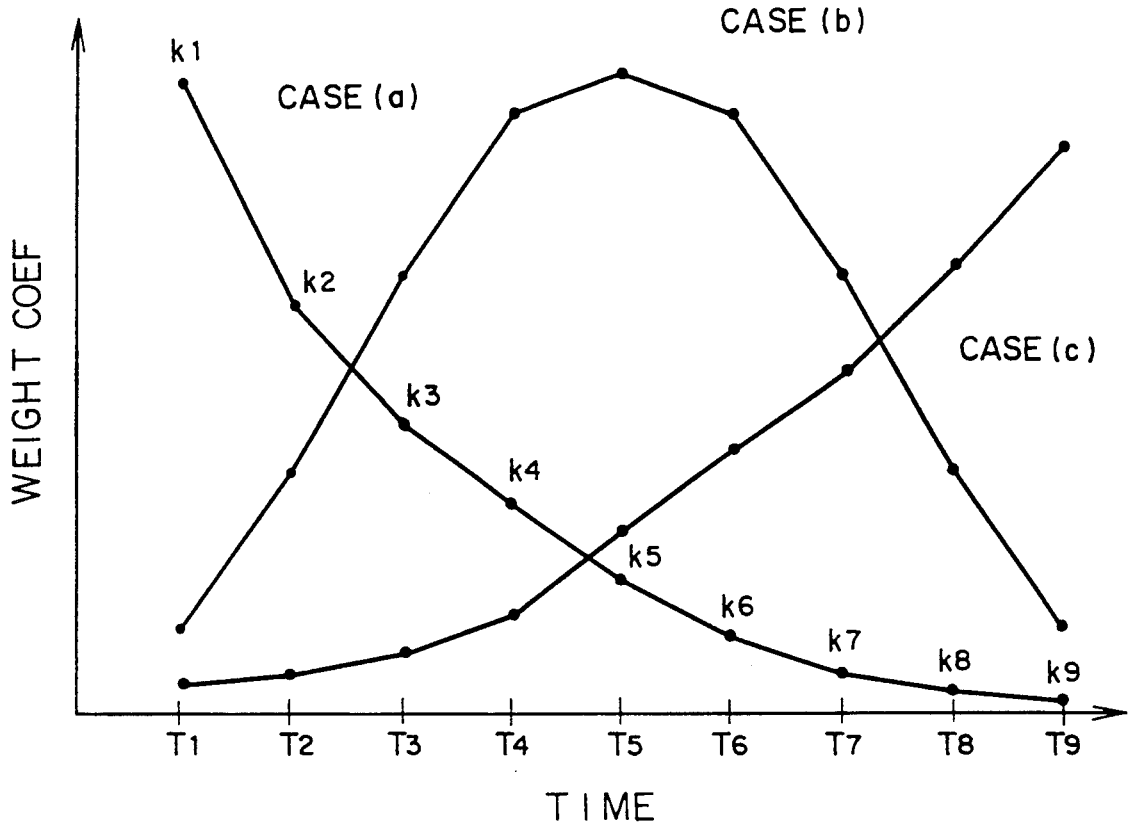
FIG. 12 is a diagram for explaining estimations in another embodiment of this invention.
Figure 13:
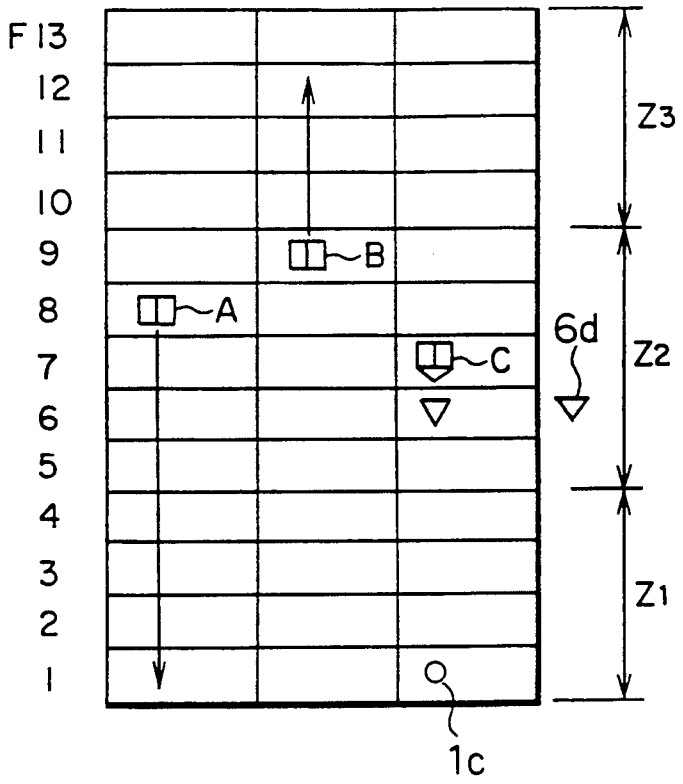
FIG. 13 PRIOR ART
FIG. 13 is a diagram showing the relationship between calls and cage positions in an apparatus for group-supervising an elevator system in the prior art.

In the foregoing embodiment, the cage positions and cage directions of respective cages after the lapse of a predetermined time have been predicted as to one predetermined time T, and standby limitation estimation values have been calculated on the basis of the predicted cage positions and cage directions. However, the final standby limitation estimation value P can also be easily set as described below: As to a plurality of predetermined times $T_1, T_2, \ldots$ and $T_r$ ($T_1 < T_2 < \ldots < T_r$), the cage positions and cage directions of the respective cages after the lapses of the predetermined times are predicted. Further, as to the plurality of predetermined times $T_1, T_2, \ldots$ and $T_r$, the predictive cage numbers $N_m(T_1)$–$N_m(T_r)$ of respective zones $Z_m$ ($m=1, 2, \ldots$) after the lapses of the predetermined times are calculated. Lastly, standby limitation estimation values $P(T_1), P(T_2), \ldots$ and $P(T_r)$ respectively set by combinations $\{N_1(T_1), N_2(T_1), \ldots\}$, $\{N_1(T_2), N_2(T_2), \ldots\}, \ldots$ and $\{N_1(T_r), N_2(T_r), \ldots\}$ are weighted and added, that, is, the estimation value P is calculated in conformance with a formula: $P = k_1 \cdot P(T_1) + k_2 \cdot P(T_2) + \ldots + k_r P(T_r)$ (where $k_1, k_2, \ldots$ and $k_r$ denote weight coefficients). In this case, a cage arrangement at only one certain point of time T is not noticed, but cage arrangements at the plurality of points of time $T_1, T_2, \ldots$ and $T_r$ are generally estimated. Therefore, the wait times of hall calls can be further shortened in the near future since the present point of time. Regarding the weight coefficients $k_1, k_2, \ldots$ and $k_r$, as illustrated in FIG. 12 by way of example, several setting aspects are considered depending upon the time-varying cage arrangement to which importance is attached. Any of the aspects may be properly selected in accordance with traffic states, the characteristics of a building, etc.

Moreover, using a plurality of predetermined times, the predetermined time of the cage arrangement is permitted to be changed depending upon traffic states, whereby the services of wait times etc. can be more enhanced.

As described above, according to this invention, when an unoccupied cage is detected, positions at which the unoccupied cage is caused to stand by are tentatively set so as to predict the numbers of cages which will lie in a certain floor or a certain floor zone after the lapse of a predetermined time, and a floor in which the unoccupied cage is to dispersively stand by is selected by estimating the predicted values. Therefore, the variation of a cage arrangement with the lapse of time can be accurately grasped, and a group supervision method for an elevator system which can shorten the wait time of a hall call and can reduce wasteful runs is provided.

What is claimed is:

1. A method of group supervision for an elevator system where building floors are grouped into zones, comprising the steps of:

(a) detecting unoccupied cages having no registered cage calls and no allotted hall calls;

(b) predicting cage positions of said unoccupied cages after a predetermined period of time;

(c) predicting a total number of cages which will be present in specified floor zones after a predetermined period of time on the basis of the predicted positions of the unoccupied cages; and (d) selecting a floor zone in which said unoccupied cages are to stand-by according to the total number of cages predicted to be present in specified floor zones.

2. A group supervising apparatus for a group supervisory elevator system comprising:

unoccupied cage detecting means for detecting an unoccupied cage having no cage calls and no allotted hall calls;

cage position predicting means for predicting the unoccupied cage position and direction after a predetermined period of time;

cage number predicting means for predicting a total number of cages which will lie in certain floors or certain floor zones after a predetermined period of time, on the basis of said predicted cage position and direction; and stand-by means for moving the unoccupied cage to a predetermined floor and holding the unoccupied cage in a stand-by state;

said stand-by means selecting the predetermined floor on the basis of the total number of cages predicted by said cage number predicting means.

3. A group supervising apparatus for an elevator system as claimed in claim 2, wherein said position predicting means calculates cage position and direction at a plurality of different predetermined times, said cage number predicting means calculates a total number of cages on a predetermined floor or predetermined floor zone at a plurality of different predetermined times.

4. A group supervision apparatus for an elevator system as claimed in claim 2, wherein said stand-by means selects a floor exceeding a specific value in the number of predicted cages in said predetermined floor zone as an unoccupied cage stand-by floor.

5. A group supervising apparatus for an elevator system as claimed in claim 2, wherein said stand-by means selects a floor in which the number of predicted cages in the predetermined floor zone becomes zero as an unoccupied cage stand-by floor.

6. A group supervising apparatus for an elevator system as claimed in claim 2, wherein said stand-by means selects a floor in which the number of predicted cages in said predetermined floor zone is zero and the number of predicted cages in the floor zone adjacent to said predetermined floor zone also becomes zero as an unoccupied cage stand-by floor.

7. A group supervising apparatus for a group supervisory elevator system comprising:

hall call registering means for registering hall calls when a hall button is depressed;

assigning means for selecting a cage to serve from among a plurality of cages, and designating the cage to respond to a hall call;

cage control means for controlling cage operations including cage traveling direction determination, departure, stoppage, opening and closure of cage doors, and responding to cage calls and assigned hall calls;

stand-by means for moving the cage to a predetermined floor and holding the cage in a stand-by state;

unoccupied cage detecting means for detecting an unoccupied cage having no cage calls and no allotted hall calls;

cage position predicting means for predicting the unoccupied cage position and direction after a predetermined period of time; and cage number predicting means for predicting a total number of cages which will lie in certain floors or certain floor zones after a predetermined period of time, on the basis of said predicted cage position and direction;

whereby said stand-by means selects the floor in which unoccupied cage is to stand-by on the basis of the total number of cages predicted by said cage number predicting means.

* * * * *